US007467735B2

(12) United States Patent
Rau

(10) Patent No.: US 7,467,735 B2
(45) Date of Patent: Dec. 23, 2008

(54) PROPORTIONING CONTAINER

(75) Inventor: Michael A. Rau, Eden Prairie, MN (US)

(73) Assignee: Minuteman International, Inc., Addison, IL (US)

( * ) Notice: Subject to any disclaimer, the term of this patent is extended or adjusted under 35 U.S.C. 154(b) by 503 days.

(21) Appl. No.: 11/262,112

(22) Filed: Oct. 27, 2005

(65) Prior Publication Data

US 2006/0091164 A1 May 4, 2006

Related U.S. Application Data

(60) Provisional application No. 60/623,476, filed on Oct. 29, 2004.

(51) Int. Cl.
*B67D 5/60* (2006.01)

(52) U.S. Cl. ..... 222/464.1; 222/158; 222/205; 222/207; 239/327; 239/350

(58) Field of Classification Search ..... 222/464.1, 222/158, 205, 207, 325, 129.2, 133, 134, 222/630; 239/327, 330, 349, 350, 356, 362, 239/363

See application file for complete search history.

(56) References Cited

U.S. PATENT DOCUMENTS 4,106,673 A 8/1978 Donoghue
4,418,843 A * 12/1983 Jackman ..... 222/158
6,148,520 A 11/2000 Berns
6,290,102 B1 * 9/2001 Jennings et al. ..... 222/158
2003/0150887 A1 * 8/2003 Laible ..... 222/529

* cited by examiner

*Primary Examiner*—Frederick C. Nicolas
(74) *Attorney, Agent, or Firm*—Wildman, Harrold, Allen & Dixon LLP

(57) ABSTRACT

A plastic container includes a squeezable bottle providing a lower main liquid reservoir for storing a cleaning solution, an upper dispensing receptacle for measuring and dispensing a measured quantity of liquid, and a transfer duct communicating a lower portion of the main liquid reservoir with an upper portion of the dispensing receptacle for transferring liquid from the main liquid reservoir to the upper dispensing receptacle. After the main liquid reservoir is filled through an opening at the base of the dispensing receptacle, the opening is closed with an insert equipped with a check valve. This same container is adapted to a single flow or double-flow proportioning container by providing a drop tube which opens the check valve and permits liquid to pass from the main reservoir through a check valve housed in a cap assembly, thence through a metering tip to a delivery tube which is in fluid communication with a proportioning device.

8 Claims, 8 Drawing Sheets

PRIOR ART FIG. 1

PROPORTIONING CONTAINER

RELATED APPLICATION

This application claims the benefit of U.S. Provisional Application No. 60/623,476 filed on Oct. 29, 2004 for "PROPORTIONING CONTAINER".

FIELD OF THE INVENTION

The present invention relates to a container for liquids, and more particularly, to a container which includes an existing plastic bottle which may be used as a proportioning container.

BACKGROUND OF THE INVENTION

Manufacturers of cleaning liquids, particularly industrial cleaning fluids for cleaning work areas, floors, washrooms and the like, generally package their liquid cleaning products in a concentrated form to save expense in storage and transportation, and to conserve storage space until use.

In proportioning (i.e. diluting) systems, a concentrated solution is diluted with tap water on site to achieve a desired use concentration. It is desirable to measure, fairly accurately, the amount of the cleaning liquid to achieve the desired solution level set by the manufacturer.

One plastic bottle used for manually measuring a desired quantity of cleaning liquid and then dispensing the measured quantity while preventing spilling or dispensing of the main reservoir of cleaning liquid is disclosed in U.S. Pat. No. 4,418,843. A similar container for measuring and dispensing liquid is disclosed in U.S. Pat. No. 4,106,673. Both of the measuring/dispensing liquid containers disclosed in these patents is suitable for storing a larger quantity of liquid concentrate in a main reservoir and then transferring a controlled, limited amount of the liquid concentrate to a graduated measuring cup or receptacle from which the measured quantity is dispensed manually to a bucket or other container of tap water without dispensing additional liquid from the main liquid concentrate reservoir. In both of the known devices identified above, a plastic "squeeze" bottle is used. By this, it is meant that the main liquid reservoir has walls which are resiliently flexible ("squeezable"), preferably made of plastic material, such that the user may squeeze opposing walls defining the main liquid reservoir and thereby transfer a measured amount of liquid to the dispensing receptacle while viewing the amount of liquid accumulating in the dispensing receptacle which is graduated for accurately measuring the desired quantity of liquid to be dispensed. The transfer of liquid from the main reservoir to the dispensing receptacle is accomplished through a transfer tube having an inlet opening located adjacent the bottom of the main liquid reservoir and an outlet opening communicating with an upper portion of the dispensing receptacle.

During the transfer stage, a closure cap is opened slightly to permit venting of air originally in the dispensing receptacle during the transfer of the desired quantity of liquid concentrate from the main liquid reservoir to the dispensing receptacle.

Typically, in prior art containers, the dispensing receptacle is located above the main liquid reservoir and originally in fluid communication with the main liquid reservoir by means of an open throat in the bottle. The container is originally filled through the open throat which is then closed by a plug or the like so that the container in the hands of the user has the main liquid reservoir which closed except for communication with the transfer tube, and a dispensing receptacle which has a closed bottom for holding the transferred liquid.

SUMMARY OF THE INVENTION

The present invention contemplates using a conventional squeeze bottle container, as described above in combination with a proportioning unit to mix the cleaning solution with tap water in a desired dilution ratio before application to an area to be cleaned. Some cleaning chemicals require one dilution ratio and others require another ratio. This is typically achieved by using metering tips with different size bores or orifices.

By accomplishing this objective, the manufacturer, distributor or customer will realize inventory savings because the same bottle could be used as a container for manual measuring and dispensing or as a source of concentrate for an automated proportioning system.

Further, the customer may use the bottle either manually or as a source in a dispensing machine. If the machine becomes disabled, the user still has the product which can be manually dispensed, mixed with the desired amount of water, and used.

To accomplish this and provide a source of liquid for a proportioning unit, the previously described plug of the conventional bottle, located between the main liquid reservoir and the metering receptacle is replaced with an insert having an actuatable valve communicating with a dip tube extending to the base of the main liquid reservoir. The valve is actuated (i.e. opened) by assembling a cap assembly to the exterior threads adjacent the mouth of the metering receptacle. The cap assembly is secured to the mouth of the measuring receptacle by means of an internally threaded coupling member which engages a peripheral flange of the cap assembly. The cap assembly includes a downwardly extending actuating tube which engages the actuatable valve in the insert and actuates the valve when the cap assembly is secured to the metering receptacle. A check valve is also incorporated into the cap assembly to avoid reverse fluid flow.

A cap assembly for achieving two different proportioning ratios includes a housing for first and second check valves, each of which communicates with an associated dispensing tube. Each dispensing tube is provided with a metering tip having a different size metering orifice. Thus, one dispensing tube may be used to provide one concentration of the cleaning fluid and the other dispensing tube may be coupled to the proportioning machine to provide a different known concentration. The cap assembly may incorporate one, two, or more dispensing tubes and associated metering tips.

Alternatively, where only one dilution ratio is desired, the metering orifice may be located elsewhere in the fluid flow path, as in the insert located between the main reservoir and the metering receptacle.

Thus, a manufacturer of cleaning solutions, for example, may use the basic plastic bottle in the traditional manual fashion simply to store the solution in the main liquid reservoir and manually transfer a measured amount to the metering receptacle by squeezing the sides of the bottle, and then dispensing the metered quantity into a bucket or other vessel, for example, by removing the cap and emptying the measuring receptacle.

Using the same plastic bottle, but incorporating the cap assembly of the present invention, the manufacturer has the option of converting the basic bottle as a manual measuring/dispensing container or as a single rate proportioning dispenser or a multiple rate proportioning dispenser. Persons skilled in the art will appreciate that three or more dilution rates could be achieved simply by including metering tips of different flow rates, thereby providing as many proportioning settings as may be desired.

Other features and advantages of the present invention will be apparent to persons skilled in the art from the following detailed description of illustrated embodiments of the invention, wherein like reference numerals will refer to the same parts in the various views.

DETAILED DESCRIPTION OF THE ILLUSTRATED EMBODIMENTS

Figure 1:
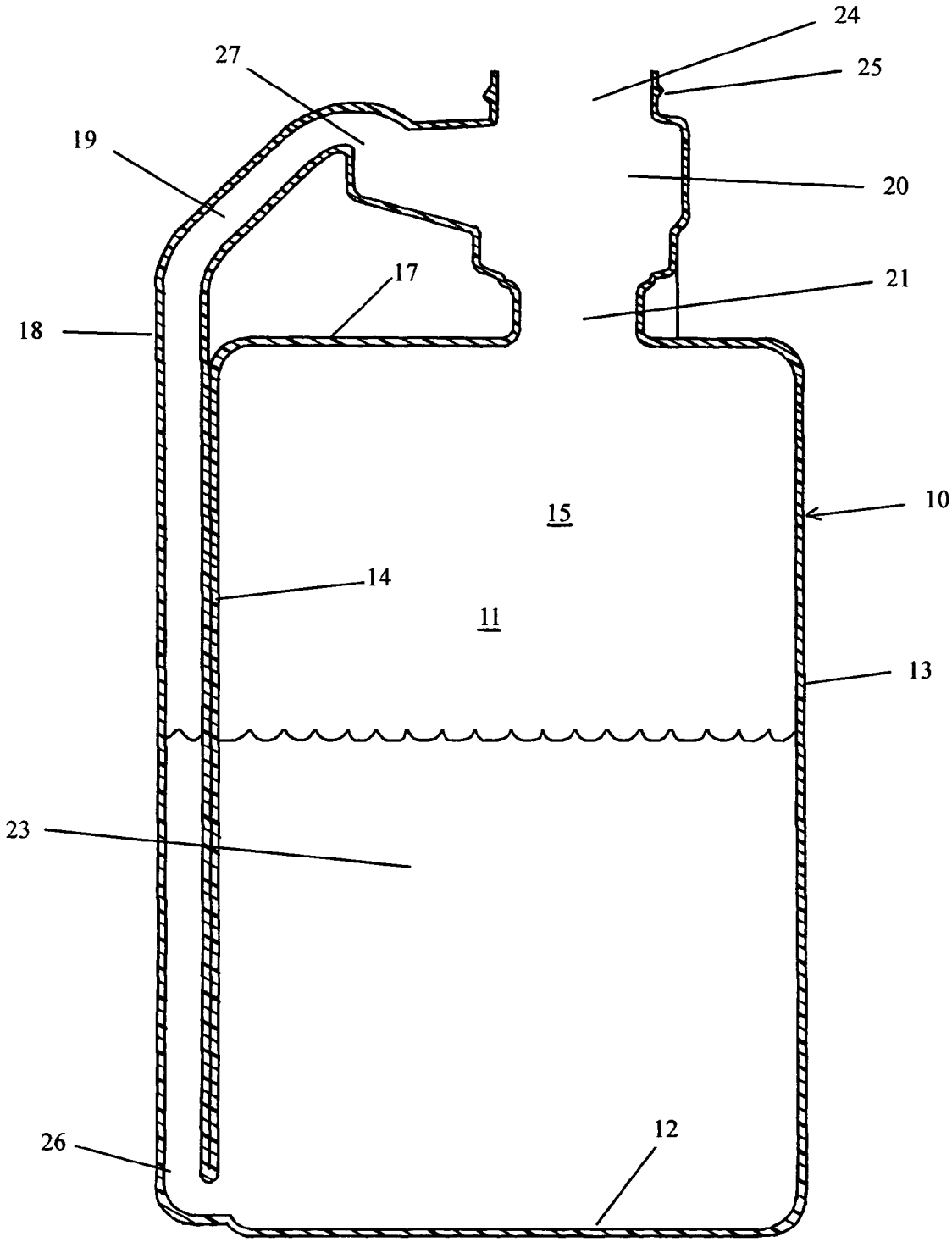
FIG. 1 is a side view of a conventional plastic bottle used as a container for storing and manually dispensing liquid, before a plug is placed in the throat of the main liquid reservoir, and without a cap.

Referring first to FIG. 1, reference numeral 10 generally designates a container or squeeze bottle known in the prior art. The bottle 10 includes a lower, main liquid reservoir 11 having a flat bottom 12 and first and second side walls 13, 14 as well as two additional opposing side walls, one of which is seen in FIG. 1 and designated 15, and a top wall 17. The two side walls 13, 14 may be relatively narrow in width as compared to the adjacent side walls, one of which is seen at 15, together with the top and bottom walls 12, 17 to form a main liquid storage reservoir 11. The larger opposing walls are flexibly resilient. The container may be made of high density polyethylene and "squeezable" by the application of normal hand pressure.

A transfer tube 18 is formed integrally with the side wall 14. A measuring or dispensing receptacle 20 (sometimes referred to as a "receptacle" for short) with graduations formed on the side, if desired, is located above the reservoir 11; and a filling opening 21 is located between the bottom of the measuring receptacle 20 and the top of the main reservoir 11.

The upper portion of the measuring receptacle 20 may be provided with external threads 25 to receive a removable closure cap (not shown in FIG. 1). The reservoir 11 is originally filled with liquid 23 through the opening 21 and the upper opening 24 of the measuring receptacle 20. After the main liquid reservoir 11 is filled with a desired amount of liquid 23 through the upper opening 24 of the measuring receptacle 20 and the opening 21, the opening 21 is closed and sealed by means of a plug (not shown in FIG. 1).

The transfer tube 18 includes a lower inlet opening 26 which communicates with the bottom of the main liquid reservoir 11, and an upper discharge opening 27 which communicates the transfer tube with an upper portion of the measuring receptacle 20. The side wall of the measuring receptacle 20 may be graduated and contain indicia showing various liquid fill levels and indications of measured liquid volumes.

In use, the user may manually transfer a measured amount of liquid 23 from the main reservoir 11 into the measuring receptacle 20 simply by squeezing opposing side walls 15 of the bottle 10, with the cap loosened sufficiently to permit air to exit to the atmosphere. This forces the liquid 23 through the inlet opening 26, up the transfer tube 18 and through the discharge opening 27 into the measuring receptacle 20. When the side walls are released, the cap 40 (FIG. 2) may be removed, and the contents of the measuring receptacle dispensed into a pail or the like, as is known in the art. It will be appreciated that the prior art bottle 10 has an important but limited use as a manual measuring/dispensing container. In particular, it is not amenable for use with a proportioning (or dilution) unit.

As persons skilled in this art are aware, proportioning units are widely used in the cleaning and maintenance industry for adding water to a cleaning concentrate to prepare a solution for use. This is illustrated diagrammatically in FIG. 2A where a conventional proportioning unit is generally designated by reference numeral 28. The proportioning unit 28 may be connected to a water source, such as a conventional faucet, representing an inlet supply of clean water 29. Reference numeral 30 designates a delivery or dispensing tube coupling the output of the container 10 to the concentrate inlet 30A of an e-gap eductor 31 having an outlet 31A which may be coupled to a solution storage tank of a floor scrubber by means of a flexible tube 38A, as seen in FIG. 2A, for example.

The eductor 31 may be of conventional design, and it mixes clean water under force from the source 29 with the concentrate from the main liquid reservoir 11 drawn through dispensing tube 30 from the modified bottle 10. The output of the proportioning unit is a desired mixture of the concentrate 23 and clean water. The mixture has the desired proportion (or dilution rate) for the cleaning solution being dispensed.

Figure 2:
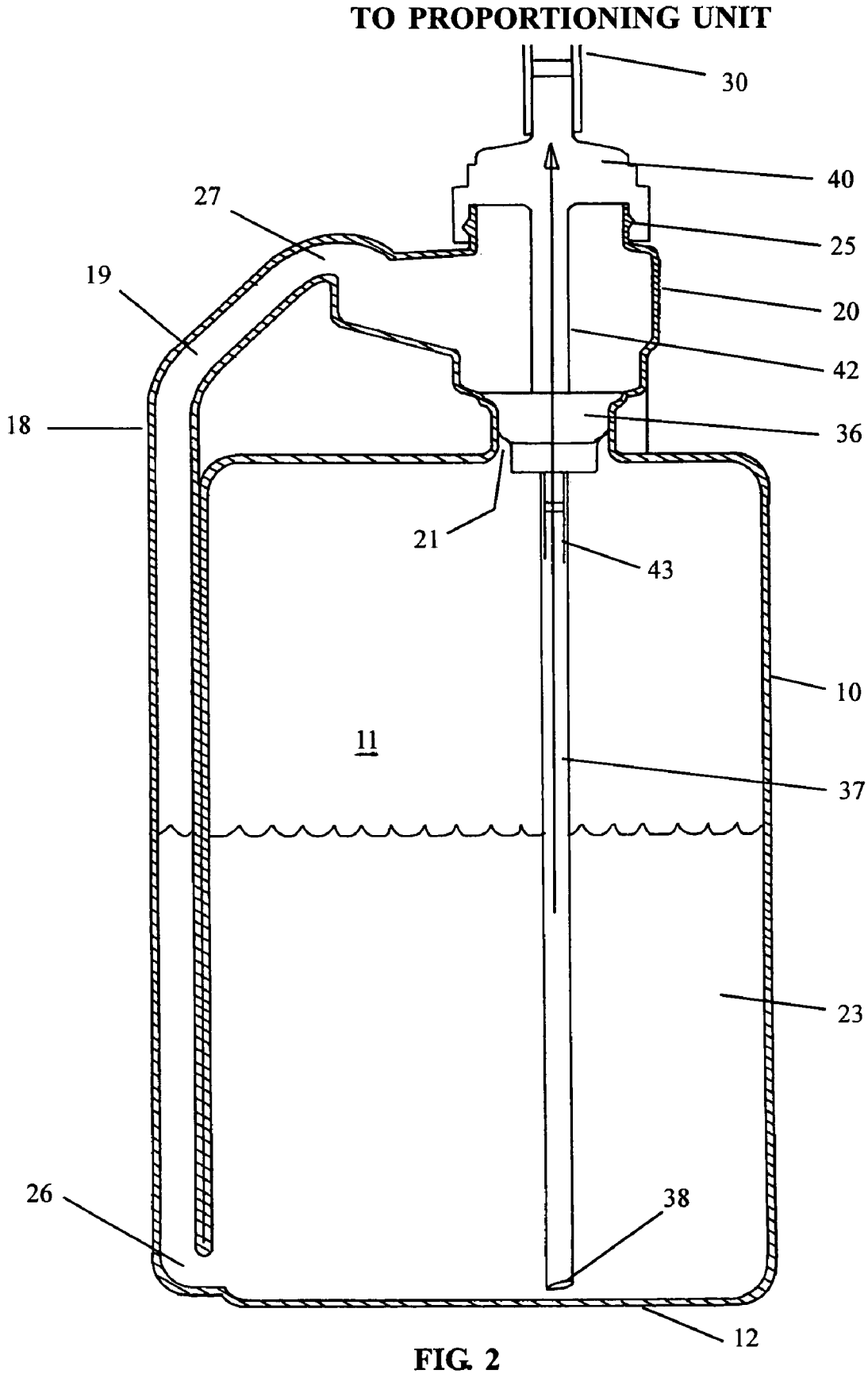
FIG. 2 is a side view of a dispensing unit employing the bottle of FIG. 1 adapted for use with a proportioning unit.
Figure 2A:
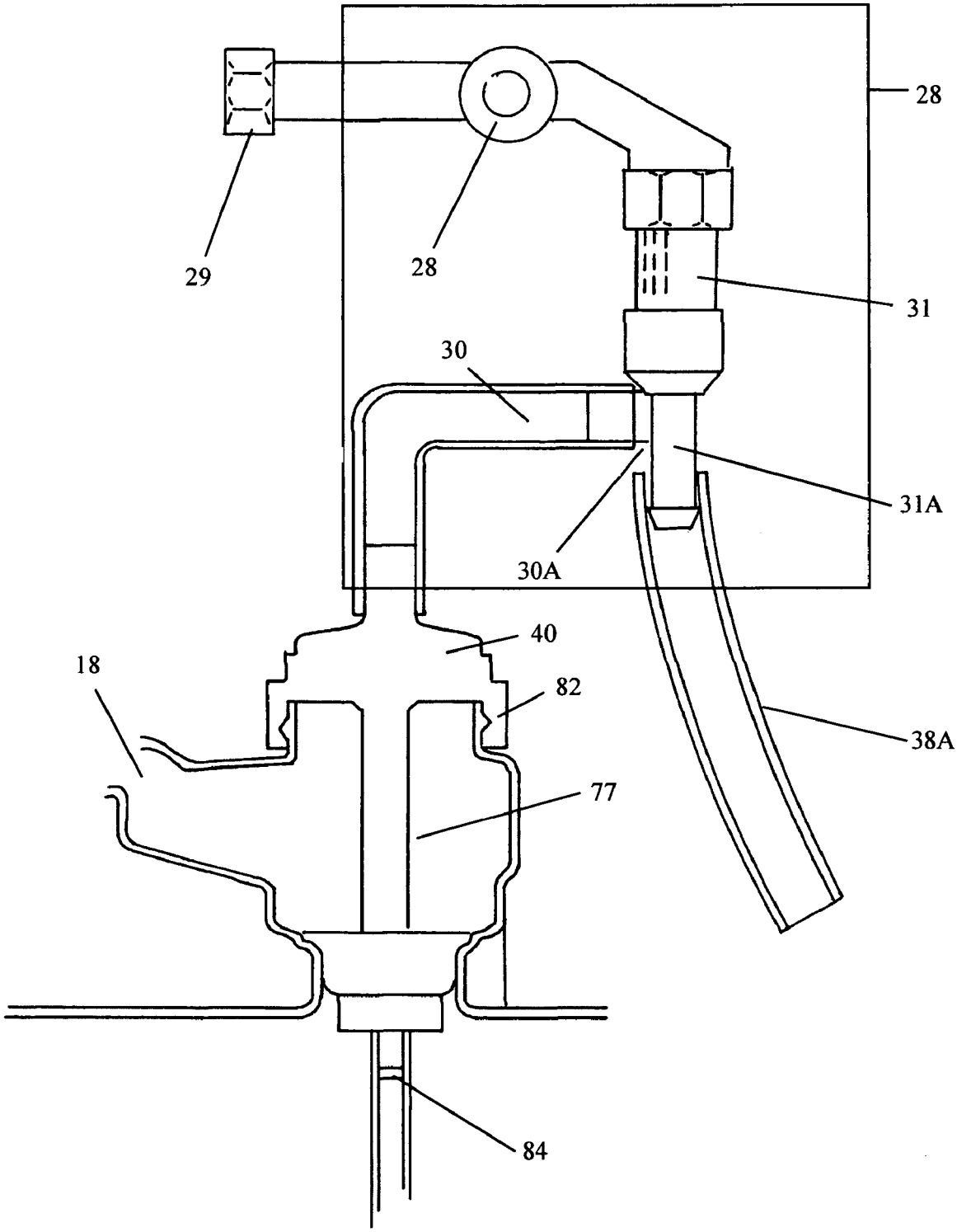
FIG. 2A is a cross sectional view of the cap assembly of FIG. 2 coupled to a proportioning unit shown in diagrammatic form.

Referring now to FIG. 2, an insert 36 is placed in the opening 21 of the bottle 10, in a manner similar to the previously described plugs, to block any further flow of liquid downwardly through the opening 21 after the original quantity of liquid 23 is placed into the reservoir 11.

Extending from the bottom of the insert 36 is a drop tube 37 which has a bottom opening 38 located adjacent the bottom 12 of the bottle 10. The opening 38 may be formed at an angle relative to the axis of the tube as shown in FIG. 2 to facilitate the take up of liquid 23. A metering tip 43 is located in the fluid passage, as will be described.

The insert 36 includes an actuatable valve, as will be described, which is normally closed (to permit the plastic container to operate conventionally as a manual measuring/dispensing container), but opened or actuated by the placement of a cap assembly generally designated 40 in FIG. 2 in assembled relation with the outer threads 25 of the measuring receptacle 20, as will be further disclosed below.

For a general overview, the cap assembly 40 includes an upright (or actuator) tube 42 which communicates with the insert 36 and actuates or opens a valve inside the insert 36 permitting fluid to flow (under suction pressure from the proportioning unit 28) in a flow path from the main liquid reservoir 11 and drop tube 37 through the insert 36 and through a check valve in the insert 36 (or cap assembly 40), and then to the delivery or dispensing tube 30 (in which the metering tip may alternatively be located), having an orifice of desired diameter for achieving the desired ratio or proportion of cleaning liquid 23 delivered to the proportioning unit 28 (FIG. 2A).

Figure 3:
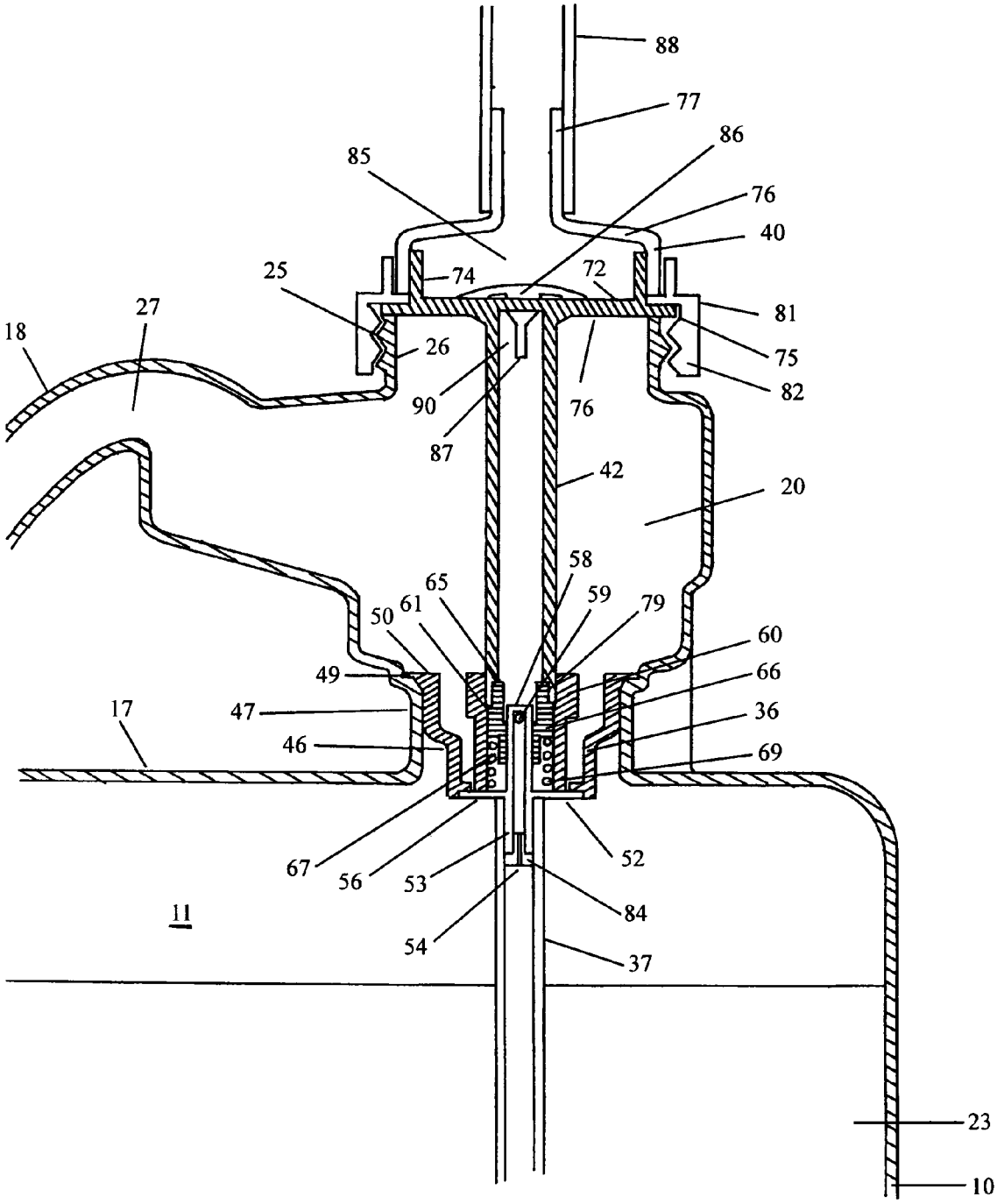
FIG. 3 is a cross sectional view of the assembly cap of FIG. 2 for a single proportioning ratio and assembled to the measuring receptacle to actuate the actuatable valve.

Turning now to FIG. 3, the insert 36 includes an outer peripheral wall 46, the upper portion of which engages and seals against the inner surface of a cylindrical throat 47 extending between the main reservoir 11 and the measuring receptacle 20. The upper edge of the outer wall 46 of the insert 36, which is circular in cross section, includes a laterally outwardly extending peripheral flange 49 which seals against a corresponding radial seat formed in the inner wall of the throat of the container 10. This seals the insert with the throat 47 and, together with the downward force of tube 44, secures the insert. Insert 36 also includes a base member 52 which may be a molded plastic part including a downwardly extending truncated tube 53 defining a central flow passage 54, an outwardly extending annular flange 56 and an upwardly extending stand tube 58 which is closed at the top but includes radial openings in quadrature such as the one designated 59, in the side thereof. A metering tip 84 having a central passage of predetermined cross section determined by the desired dilution ratio is fit into the bottom of the tube 52.

The insert 36 also includes an inner wall 60 having an inwardly extending support flange 61. A valve member 63 is located on the inside of the inner wall 60. The valve member 63 includes an upwardly extending cylindrical wall 65, and a horizontal flange 66 and a lower cylindrical wall 67. The lower cylindrical wall 67 is slidably received on the outside of the upwardly extending stand tube 58 of the base member 52. A coil spring 69 is located within the lower portion of the inner wall 60 of the insert. The bottom of the coil spring 69 is seated on the horizontal flange 56 of the base member 52; and the upper end of the coil spring 69 engages the lower surface of the horizontal flange 66 of the valve member 63. The spring 69 is in compression, to bias the valve member to a raised or sealing position which is defined when the horizontal flange 66 of the valve member engages and is limited in its upward motion by the internal horizontal flange 61 of the inner wall 60. In this position, the inner surface of the lower tubular portion 67 of the valve member seals the radial openings 59 in the upwardly extending stand tube 58, and precludes the passage of liquid.

The valve member 63 is actuated to the open position shown in FIG. 3 in a manner to be presently described.

Turning now to the top of FIG. 3, the cap assembly 40 includes a body 72 having a disc shape and provided with a peripheral rim 75 extending outwardly of a cylindrical side wall 74 of the body 72. Integrally molded or otherwise fixed to the body 72 is a downwardly extending tube 42. The tube 42 is generally cylindrical in shape and includes a lower end which is recessed to provide an inner annular groove 79 (best seen in FIG. 4) which receives and snugly fits on top of the upper cylindrical wall 65 of the valve member 63.

The flange 75 of the body 72 of the cap assembly is sized to close and seal the upper inlet opening of the measuring receptacle 20; and the lower surface 76 of the flange 75 rests on the upper edge of the throat opening 26 of the measuring receptacle 20. A coupling 81 having an internally threaded side wall or skirt 82 fits over the cap assembly and engages the upper surface of the flange 75 of the cap assembly so that when the coupling member 81 is threadedly engaged with the exterior threads 25 adjacent the inlet opening 26 of the measuring receptacle, the length of the tube 77 is such as to lower, and thereby actuate (i.e., open) the valve 66, by causing it to be translated downwardly and to clear the openings 59 of the stand tube 58, and thereby permit the flow of liquid 23 from the main liquid reservoir 11.

The cap assembly 40 defines a housing 85 located above the body 72 for housing a check valve 86 having a stem 87 and an annular recess for securing the valve 86 to body 72 of the cap assembly by means of a fastener 89 which defines an opening for receiving the valve 86 which is flexible and resilient, such as a polymer or rubber, to form a barbed portion for securing it.

The upper portion of the side wall 74 of the cap assembly 40 is provided with an inwardly extending upper wall 76 which is formed integrally with an upright tubular extension 77. Tubular extension 77 receives and is coupled to a dispensing or delivery tube 88, which is the same as dispensing tube 30 in FIGS. 2 and 2A. Alternatively, a metering tip may be placed inside the delivery tube 88 to establish the flow rate of fluid 23, and thus the proportioning ratio, as persons skilled in the art will appreciate.

Figure 4:
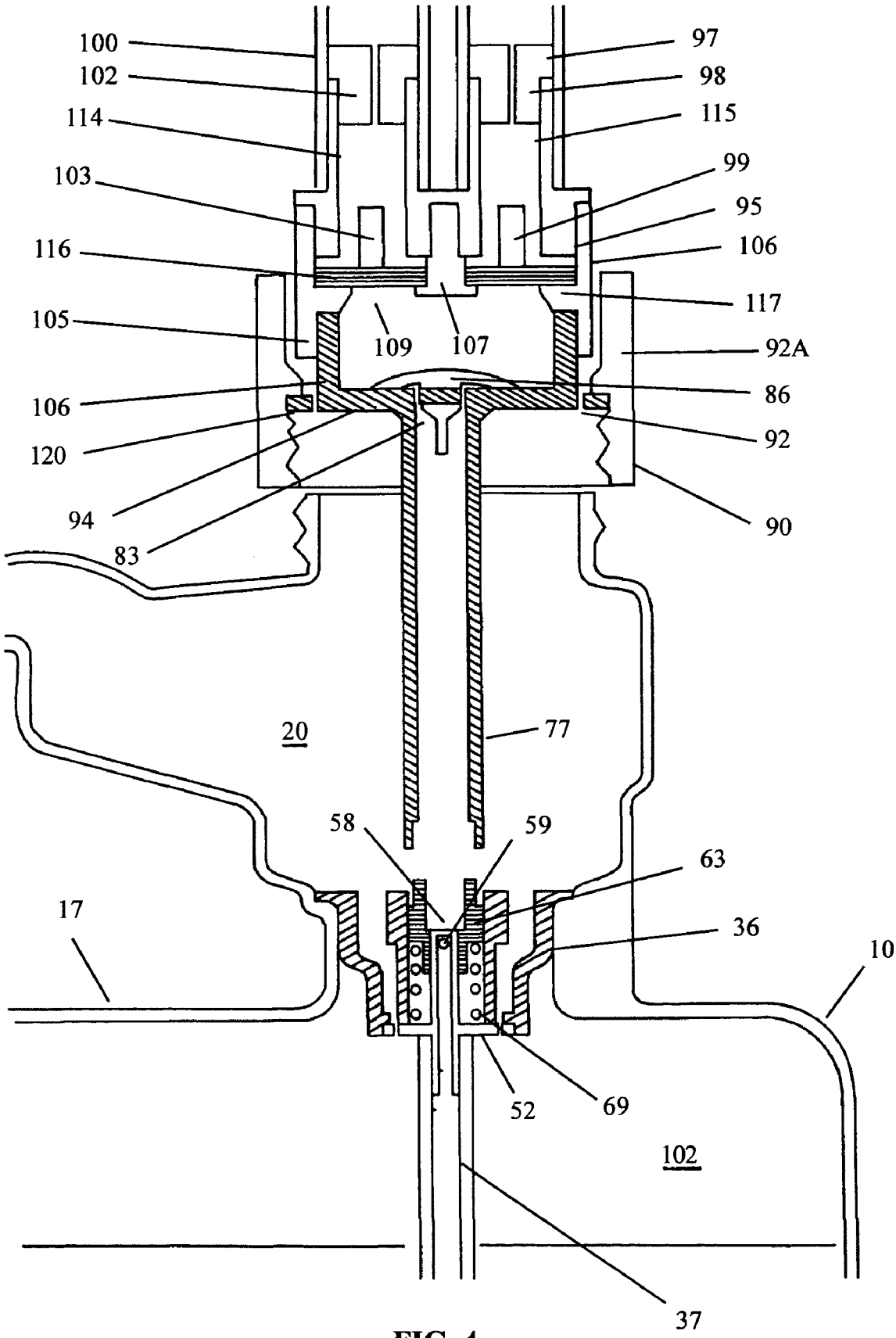
FIG. 4 is a cross sectional view of the container and a cap assembly adapted for two different proportioning ratios, with the cap assembly positioned just prior to its assembly to the measuring receptacle.
Figure 5:
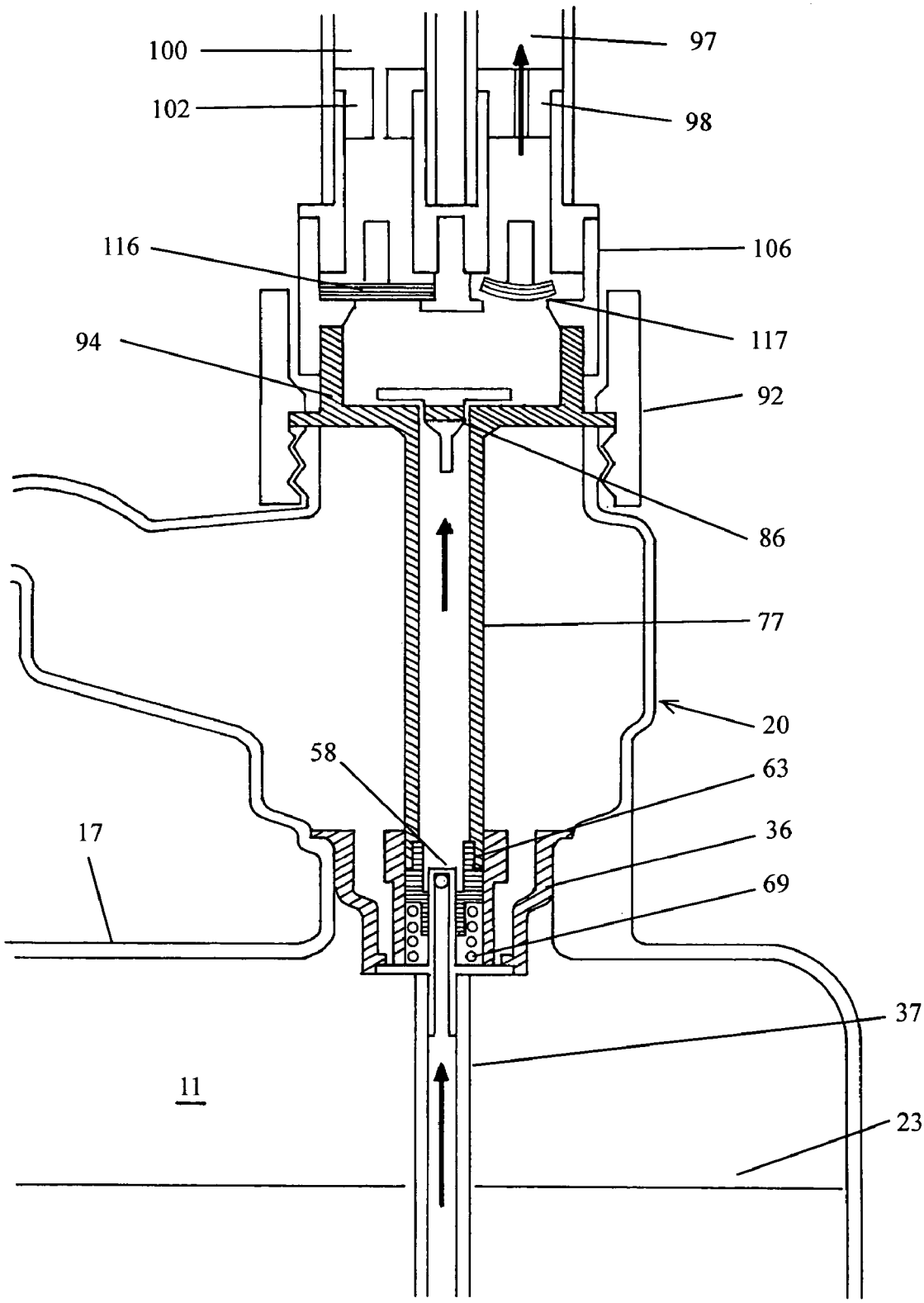
FIG. 5 is a vertical cross sectional view of the container with the cap assembly assembled to the measuring receptacle showing the path of liquid flow through the insert and the cap assembly for one of the selected proportioning ratios.

In FIGS. 4 and 5, there is shown an alternate or dual ratio cap assembly generally designated 90 which may be used to provide two different proportioning ratios. Other arrangements such as three or more proportioning ratios might equally well be employed.

Figure 3A:
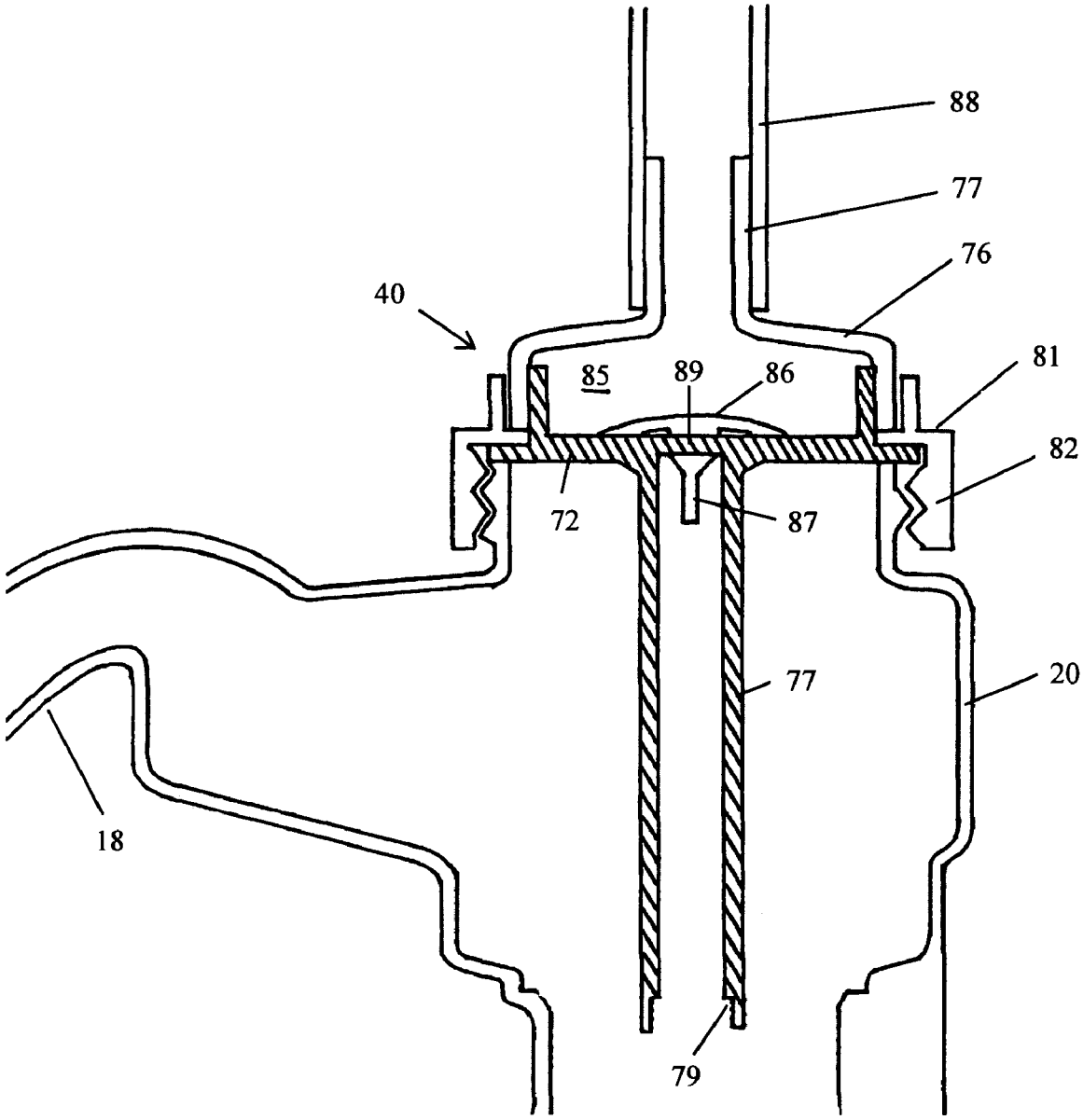
FIG. 3A is a cross sectional view of the container and cap assembly of FIG. 2 showing the mounting of the check valve in the cap assembly.

Turning then to FIGS. 4 and 5, the bottle or container 10 and the insert 36 and actuatable valve member 63 and spring 69 may all be the same as previously described, including the base member 52 and drop tube 37. The cap assembly 90 includes a threaded coupling member 92 which is similar to the previously described coupling member 82 (FIG. 3A) in that it has an internally threaded ring, coupling member 92 has an upwardly extending side wall 92A (as with the modification of FIG. 3A) for gripping purposes and to provide additional protection to the operative elements of this dispensing unit. The cap assembly 90 also includes a body 94 and a holder or mounting base 95 which is fixed to the insert body 94 and forms a mounting base for two output metering units having different flow rates (i.e. metering orifices). As with the embodiment of FIGS. 3, 3A, the coupling member is freely rotatable relative to the body which carries tube 42.

One metering outlet assembly (or dispensing unit) includes a dispensing tube 97 in which there is inserted a first metering tip 98 and a check valve 99. The second dispensing unit includes a dispensing tube 100, a second metering tip 102 (which, in the illustrated embodiment, has a narrower orifice than the metering tip 98, presented by way of example only) and a second check valve 103.

The holder or mounting base 95 includes a lower peripheral cylindrical wall 105 which secures the base 95 to an upright cylindrical wall 106 of the insert member 94. The base 95 also includes an upwardly extending cylindrical wall 106 which supports a central member 107 which cooperates with the holder to define two outlet ports 108 and 109 associated respectively with the check valves 99, 103.

The holder 95 defines receptacles for receiving tubular extensions 114 and 115 respectively. The tubular extensions 114, 115 are sealed at the base 95, and dimensioned to receive the dispensing tubes 100, 97 respectively in sealing engagement. The check valves 99, 103, include flexible sealing members 116, 117 respectively which may be in the form of thin flexible discs, held in place by the stops 103, 99 respectively.

The metering tips 98, 102 may be color-coded for indicating their respective flow rates; and the delivery tubes 97, 100 may be transparent or translucent flexible, polyethylene tubes, so that the color of the metering tips 98, 102 may be readily observed.

In operation of the embodiment of FIGS. 4 and 5, once the user secures the coupling member 92, he or she then selects which proportioning unit is desired. By way of further illustration, it will be assumed that the greater proportioning unit including the delivery tube 97 and metering tip 98 will be used. The delivery tube 97 is then assembled to the proper input of the proportioning unit 28 (FIG. 2A), and the proportioning unit is turned on.

Liquid is aspirated by the eductor 31 from the liquid source 23 in the main liquid reservoir 11, through a fluid flow path including the drop tube 37, lower insert 36, tube extension 77, in-line check valve 86 and the selected delivery tube, associated check valve (99 or 103) and dispensing tube.

Specifically, liquid being dispensed flows through the openings 59 in the valve stand tube 58 because the lower valve member 63 has been actuated (opened), by virtue of tightening the threaded coupling member 92 onto the external threads of the mouth of the measuring receptacle 20 of the bottle 10. The interior groove 79 (FIG. 3A) at the base of tubular extension 77 engages the upper annular portion of the valve member 63 and moves it axially downwardly against the preload force of the spring 69, thereby actuating or opening the valve by unsealing the openings 59 in the stand tube 58. Liquid (i.e., the concentrate) flows under the suction pressure of the eductor, upwardly in the direction of the arrows in FIG. 5 (i.e., through the flow passage), through the tubular extension (or actuating tube ) 77 and the check valve 86, and thence through the check valve 99 located at the base of the holder 106 (see FIGS. 4 and 5). The fluid then flows upwardly through the selected metering tip 98 and, through the delivery tube 97 into the proportioning unit as seen in FIG. 2A. As concentrate is drawn out from the reservoir, make-up air is admitted through circumferentially spaced openings 110 formed in the disc-shaped body 94. The make-up air then flows through receptacle 20 and transfer tube 18 into the reservoir.

Figure 6:
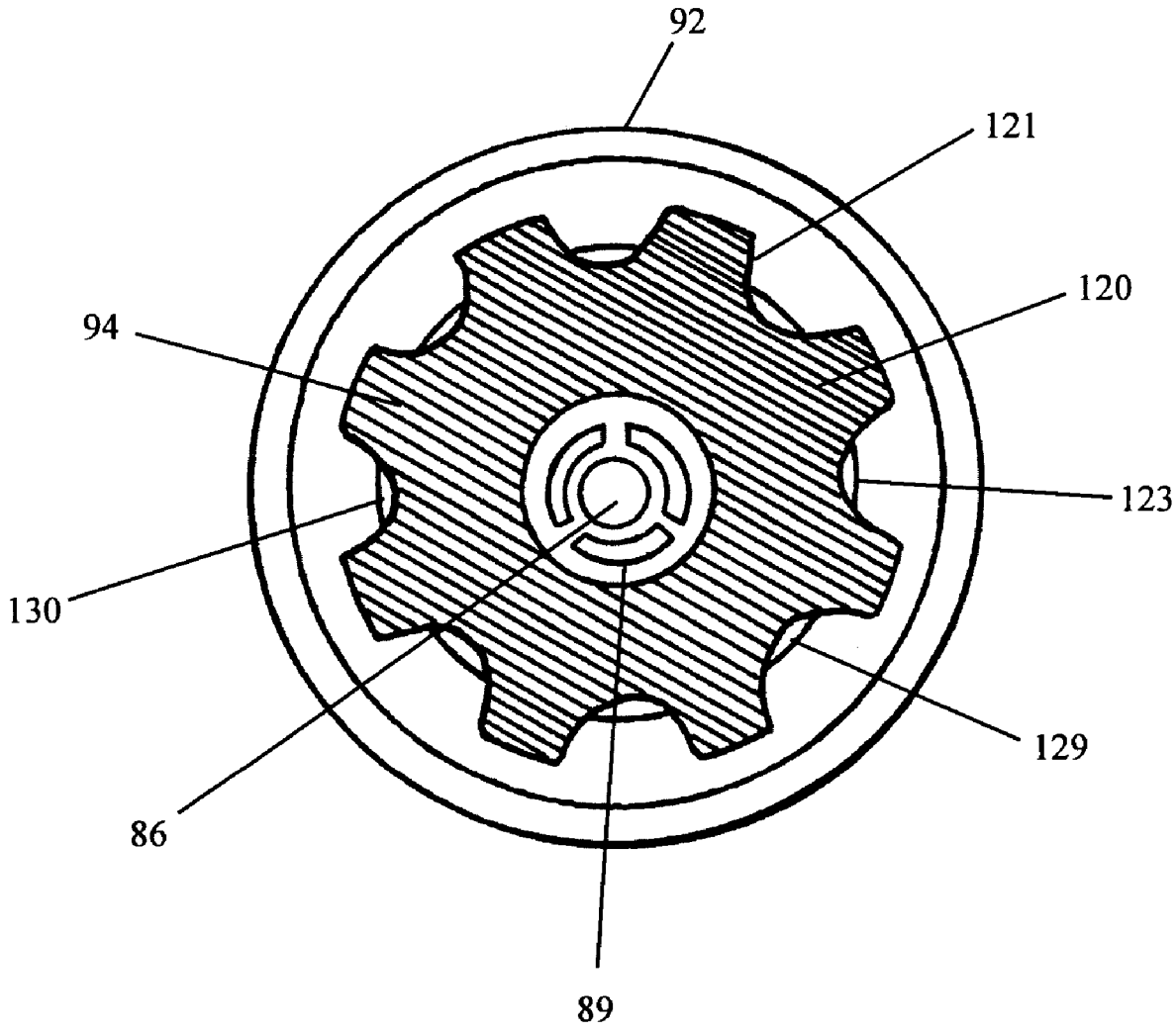
FIG. 6 is a bottom view of the bottom of the cap assembly alone.

Turning now to FIG. 6, in an alternative for providing make-up air, a disc-shaped body 94 has a peripheral flange 120 in which is formed a series of radial recesses 121 which are spaced circumferentially and extend radially inwardly, and which have innermost edges 123 spaced inwardly of the inner circumferential edge 129 (see FIG. 4) of the coupling member 92. This provides vent openings such as the one designated 130 in FIG. 6, allowing make-up air to enter the container 10 (via receptacle 20 and transfer tube 18) as liquid is being drawn out during dispensing.

It will thus be observed that the same container or squeeze bottle 10 serves a number of different purposes. First, as illustrated in FIG. 1, it permits the manufacturer to use the bottle as a conventional container for a liquid, and permits the liquid to be manually, but accurately and reliably, measured in a dispensing receptacle and then dispensed through the mouth 24 of the dispensing receptacle.

The embodiments of FIGS. 2, 2A, 3 and 3A permit the user as well as the manufacturer to use the same bottle 10 with a conventional proportioning unit having a single metering tip for a predetermined proportioning ratio of cleaning solution, for example, to water.

Finally, the embodiment of FIGS. 4-5 permit the user as well as the manufacturer to use the same bottle 10 with a dual metering/dispensing cap assembly which allows the user to view a color-coded metering tip and then select the associated dispensing tube for connection to the proportioning unit.

Having thus disclosed in detail various embodiments of the invention, persons skilled in the art will be able to modify certain of the structure which has been illustrated and to substitute equivalent elements for those disclosed while continuing to practice the principle of the invention; and it is, therefore, intended that all such modifications and substitutions be covered as they are embraced within in the spirit and scope of the appended claims.

I claim:

1. A container for use with a liquid proportioning unit, comprising:

a container for storing a liquid to be diluted, said container including a main liquid reservoir, a receptacle above said main liquid reservoir having a first opening between said main reservoir and a bottom of said receptacle, a dispensing opening in said receptacle;

and a transfer tube extending between said main reservoir and said receptacle;

an insert in said first opening and sealing against an inner surface of said container;

a drop tube extending downwardly in a use position from said insert and having an inlet opening located adjacent a bottom of said container in the use position for drawing the liquid from said main reservoir;

a first actuatable valve housed in said insert, including an actuatable member biased to a closed position for closing said first opening, said valve permitting fluid flow from said main reservoir through said first valve, when actuated;

a cap assembly adapted to couple to said receptacle adjacent said dispensing opening of said receptacle and including a tubular extension engaging said actuatable member of said first valve and actuating same member to open said first valve when said cap assembly is assembled to said receptacle, thereby opening a fluid dispensing passage;

a first check valve in fluid communication with said fluid dispensing passage permitting unidirectional flow therein; and a metering tip in said fluid dispensing passage.

2. The container of claim 1 further comprising:

a first delivery tube extending from said cap assembly and including a first metering orifice;

a first check valve in fluid communication with said actuatable valve and said first delivery tube;

a second delivery tube, including a second metering orifice defining a different flow characteristic than said first metering orifice, said second delivery tube extending from said cap assembly and forming a second leg of said fluid dispensing passage; and a second check valve in fluid communication wit said second delivery tube whereby a proportioning unit may be coupled to one of said first and said second delivery tubes to achieve a desired mixing ratio.

3. The container of claim 1 wherein said insert includes an outer wall sealed against an inner surface of a lower portion of said receptacle and including a stand tube for receiving said actuatable member adapted for movement between a closed position and an open position and further comprising;

a spring biasing said sealing member to a closed position, thereby preventing fluid from passing trough said first valve, said actuating tube adapted to engage said valve member when said cap assembly is coupled to said container, thereby moving said valve member from said closed position to an open position against the biasing of said spring.

4. The apparatus of claim 3 wherein said cap assembly includes an outwardly extending peripheral flange, said apparatus further including a coupling member engaging said peripheral flange of said cap assembly and having internal threads for engaging upper exterior threads of said receptacle adjacent an outlet opening thereof, for removably coupling said cap assembly to said receptacle and positioning said actuating tube to engage and actuate said valve member to an open flow position.

5. The apparatus of claim 2 wherein each of said first and second check valves of said first and second delivery tubes includes a flexible sealing member engaging and closing an opening respectively in said first and second delivery tubes and resting against a peripheral support defined in a holder mounting said first and second delivery tubes, said flexible sealing members flexing and opening its associated fluid passage when the fluid flows in a delivery direction, and closing said opening when said fluid is not forced in said direction of flow to preclude the fluid from flowing in an opposing direction.

6. The apparatus of claim 1 wherein said cap assembly includes an annular flange defining a central opening; and a flange member cooperating with said outer annular portion of said cap assembly to define a plurality of circumferentially spaced openings permitting air to flow into said receptacle and thence to said container through said transfer tube to permit air to flow into said container as the liquid is drawn therefrom.

7. A liquid proportioning container for use with a liquid proportioning unit, comprising:

a plastic container for storing a cleaning liquid in concentrate form, said container including a main liquid reservoir, said container having opposing squeezable side walls defining a main liquid reservoir, an integral receptacle above said main liquid reservoir and communicating with said main liquid reservoir by means of a first opening, an upper portion of said receptacle defining a spout having external threads, and a transfer tube extending between a lower portion of said main reservoir and an upper p onion of said receptacle;

an insert in said first opening of said container sealing against a portion of said container defining said first opening;

a drop tube extending from said insert and having an inlet opening in a lower portion of said main reservoir for drawing the liquid therefrom;

a first valve housed in said insert and including an actuatable member biased to close said first valve in a normal, unactuated position, said first valve permitting fluid flow from said main reservoir through said drop tube and said valve, when actuated;

a cap having threads adapted to couple to said threads of said receptacle and including an actuating tube positioned to engage said actuatable member of said first valve when said cap is threaded onto said receptacle for actuating said first valve to an open position, thereby opening a fluid passage from said inlet opening of said drop tube to said cap assembly;

a check valve and inset fluid passage permitting unidirectional flow from said main reservoir; and a delivery tube including a metering orifice extending from said cap assembly and forming a delivery portion of said fluid passage, said delivery tube being adapted to be coupled to a proportioning unit.

8. The container of claim 7 wherein said cap assembly defines at least one air make-up opening permitting air to flow into said receptacle and into said reservoir.

* * * * *

UNITED STATES PATENT AND TRADEMARK OFFICE

CERTIFICATE OF CORRECTION

PATENT NO. : 7,467,735 B2
APPLICATION NO. : 11/262112
DATED : December 23, 2008
INVENTOR(S) : Michael A. Rau It is certified that error appears in the above-identified patent and that said Letters Patent is hereby corrected as shown below:

Column 8, line 33 claim 1, “actuating same member” should read --actuacting said member--

Column 8, line 51 claim 2, “communication wit said” should read --communication with said--

Column 8, line 61 claim 3, “passing trough said first” should read --passing through said first--

Column 10, line 6 claim 7, “and an upper p onion of said” should read --and an upper portion of said--

Signed and Sealed this

Twelfth Day of May, 2009

JOHN DOLL
*Acting Director of the United States Patent and Trademark Office*